US005289857A

United States Patent [19]

Pyles

[11] Patent Number: 5,289,857

[45] Date of Patent: Mar. 1, 1994

[54] VAPOR RECOVERY SYSTEM

[76] Inventor: Charles E. Pyles, 1317 Wilson Rd., Waldorf, Md. 20602

[21] Appl. No.: 798,817

[22] Filed: Nov. 27, 1991

[51] Int. Cl.[5] ..... B65B 31/00

[52] U.S. Cl. ..... 141/59; 141/45; 141/95; 141/290; 141/302; 220/565; 137/265; 137/587

[58] Field of Search ..... 141/59, 44, 45, 46, 141/285, 290, 301, 302, 94, 95, 86; 220/23.83, 565, 4.12; 137/265, 587, 588, 589, 312

[56] References Cited

U.S. PATENT DOCUMENTS

| | | | |
|---|---|---|---|
| 2,160,683 | 4/1937 | Spaeth | 141/290 |
| 3,807,433 | 4/1974 | Byrd | 141/290 |
| 3,915,205 | 10/1975 | Wagner et al. | 141/1 |
| 3,956,903 | 5/1976 | Hiller | 62/54 |
| 3,983,913 | 10/1976 | Bower | 141/285 |
| 3,996,976 | 12/1976 | Hansel | 141/285 |
| 4,047,548 | 9/1977 | Wagner | 141/52 |
| 4,058,148 | 11/1977 | Potter | 141/290 |
| 4,090,525 | 5/1978 | Potter | 137/171 |
| 4,253,503 | 3/1981 | Gunn | 141/59 |
| 5,078,187 | 1/1992 | Sharp | 141/290 |

*Primary Examiner*—Henry J. Recla
*Assistant Examiner*—Steven O. Douglas
*Attorney, Agent, or Firm*—Stevens, Davis, Miller & Mosher

[57] ABSTRACT

A plurality of hydrocarbon storage tanks, each storage tank has a) a fill conduit, b) a vapor recovery conduit and c) a vent line. The vent lines of the hydrocarbon storage tanks are directly connected to the vapor recovery risers and a manifold bar is connected to every vent line. The system allows for the maximum recovery of vapors during simultaneous filling of at least three storage tanks. The system also includes a vapor recovery pipe connected to at least one of the vent lines for receiving the vapor recovered from the vapor-recovery unit of hydrocarbon nozzles which dispense hydrocarbons to automobiles.

15 Claims, 3 Drawing Sheets

VAPOR RECOVERY SYSTEM

FIELD OF THE INVENTION

The present invention relates to a device for recovering hydrocarbon vapors from underground storage tanks as the tanks are filled.

BACKGROUND OF THE INVENTION

The Environmental Protection Agency of the Federal Government and similar regulatory agencies of the States require capture or recycle of hydrocarbon vapors created during the filling of gasoline storage tanks at a gasoline service station. These regulations also require that vapors be recovered from the gasoline tanks of automobiles during fill-ups.

U.S. Pat. No. 3,915,205 to Wagner (the disclosure of which is herein incorporated by reference) discloses a vapor recovery system for recovering hydrocarbon vapors from storage tanks and from automobiles during fill-ups. The system illustrated in FIG. 3 includes a manifold 126 wherein vent lines from a plurality of hydrocarbon storage tanks are directed. Also in communication with the manifold 126 is a vent line 130 for venting vapors to the atmosphere and a vapor recovery line 131. Because of the proximity of vent line 130 to the vent lines of the storage tanks vapors are just as likely to escape to the atmosphere through vent line 130 as vapors are likely to travel up vapor recovery line 131. The presence of only a single vent line to the atmosphere is disturbing because if this vent line is ever plugged by debris or destroyed by accident the hydrocarbon storage tanks will not vent during regular operation of the service station. Clogging or plugging of the vent line 130, in addition to being illegal, creates a hazardous situation.

The present invention overcomes these disadvantages of the prior art.

BRIEF SUMMARY OF THE INVENTION

The present invention includes a plurality of hydrocarbon storage tanks, each storage tank has a) a fill-riser, b) a vapor recovery riser and c) a vent line. The vent lines of the hydrocarbon storage tanks are directly connected to the vapor recovery risers and a primary manifold bar is connected to every vent line. The system allows for the maximum recovery of vapors during simultaneous filling of at least three storage tanks. The system also includes a pipe or line connected to at least one of the vent lines for receiving the vapor recovered from the vapor-recovery unit of gasoline dispenser for automobiles.

DETAILED DESCRIPTION OF THE INVENTION

Figure 1:
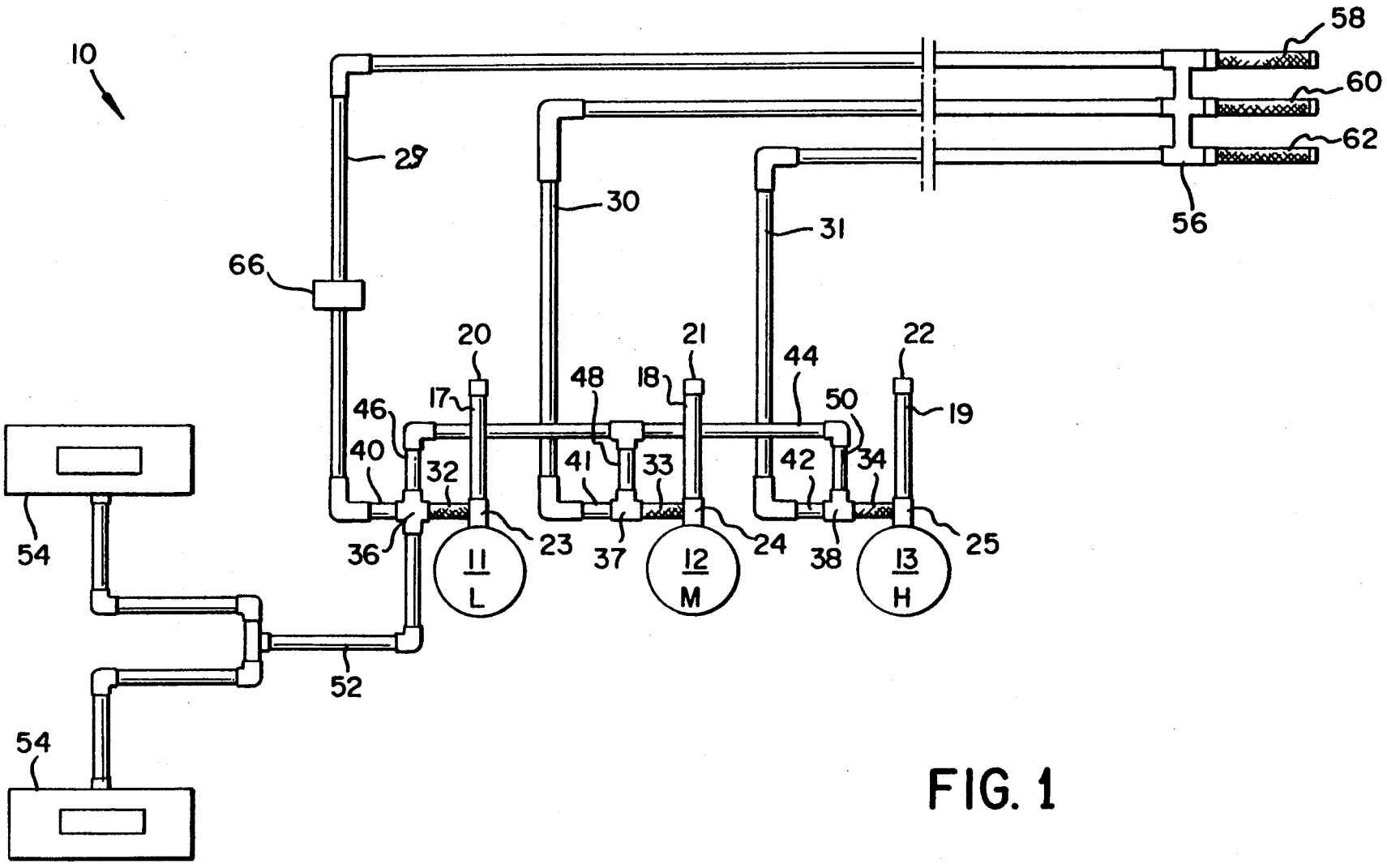
FIG. 1 is a schematic diagram of the vapor recovery system of the invention.
Figure 2:
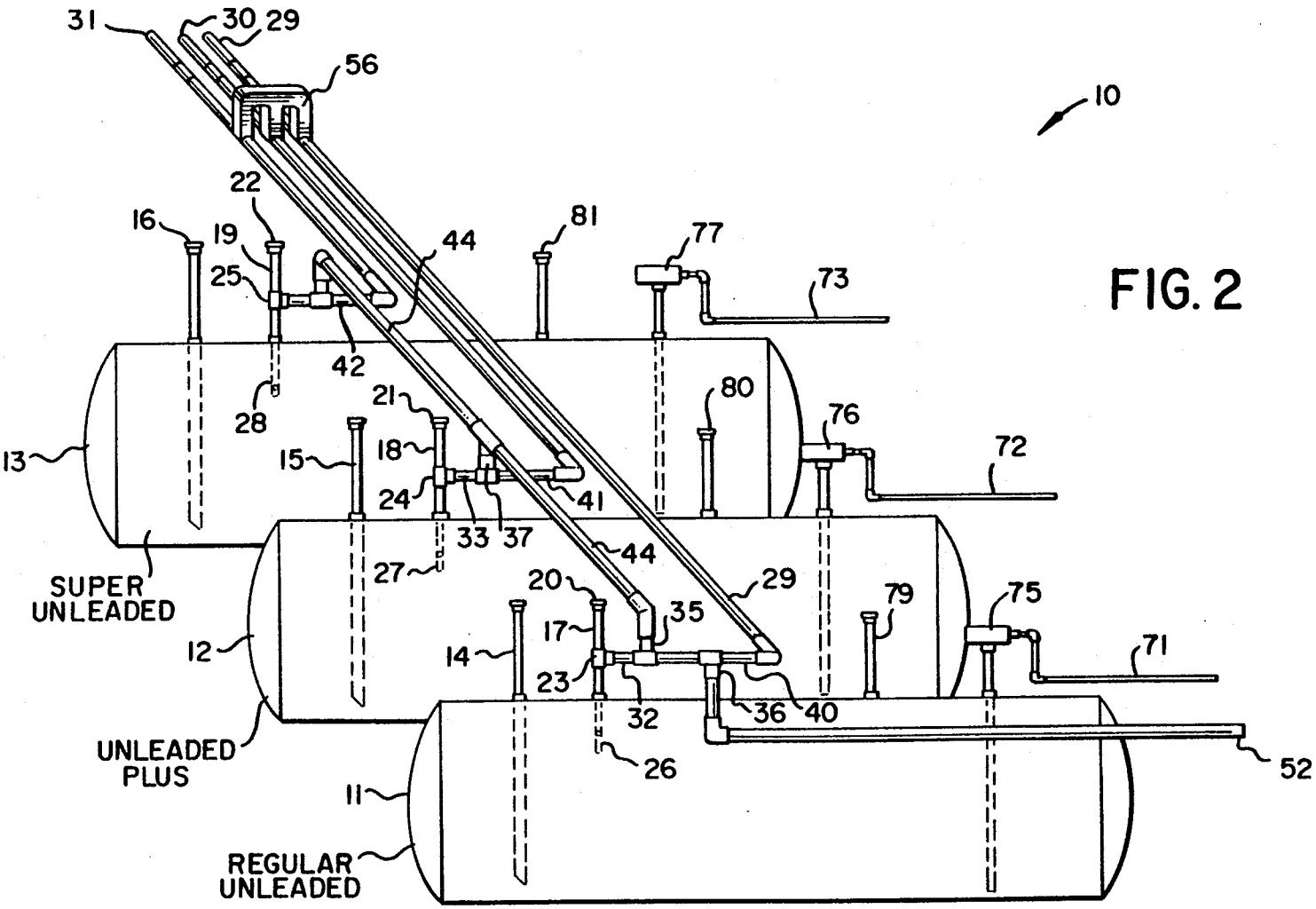
FIG. 2 is a perspective drawing of the vapor recovery system.
Figure 3:
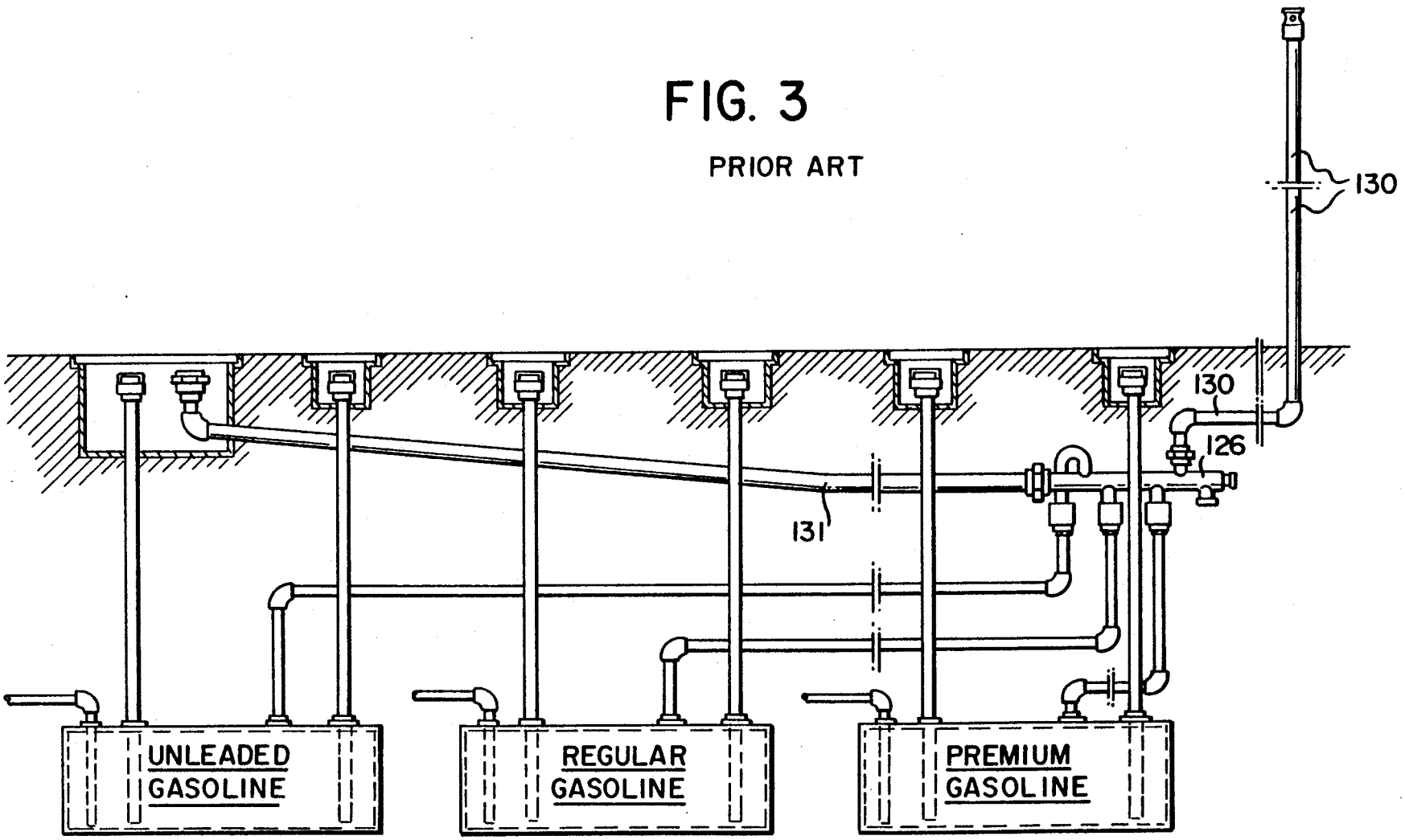
FIG. 3 PRIOR ART
FIG. 3 is a schematic diagram of a vapor recovery system according to the prior art.

With reference to FIGS. 1 and 2 the vapor recovery system 10 of the invention includes underground hydrocarbon storage tanks 11, 12 and 13. These tanks may include for storage different types or grades of fuel. For example, tank 11 may contain regular unleaded gasoline, tank 12 may contain unleaded plus and tank 13 may contain super grade gasoline. Positioned at the top of each of tanks 11, 12 and 13 is a fill line or fill-riser 14, 15 and 16 respectively which extends from the tank to above grade (see FIG. 2). Fill-risers 14 through 16 extend well into the interior of the tanks so that a minimum amount of vapor is generated as the tanks are being filled. Also located at the top of tanks 11, 12 and 13 are vapor recovery risers 17, 18 and 19, respectively having positioned at the top thereof vapor recovery or dry-break hook-ups 20, 21 and 22 and which extend above grade. The four inch (inner diameter) vapor recovery risers 17, 18 and 19 are connected to T-fittings 23, 24 and 25 (known in the trade as extractors) which include a four inch (inner diameter) pipe extension which extends approximately six inches into the interior of tanks 11–13. T-fitting 23, 24 and 25 have three connection ports. Two of the ports are approximately four inches and the third is three inches. Each extension of the extractors is fitted with a ball float valve 26, 27 and 28 that is positioned within the section of an extension pipe that extends into each tank. A ball float valve may be serviced through an extractor. The ball float valve is designed to prevent the flow of hydrocarbon vapor or liquid through a vapor recovery riser when the liquid hydrocarbon level in a tank is less than six inches below the top of a tank, i.e., when 95% of tank capacity is reached.

Connected to each vapor recovery riser 17, 18 and 19 at T-fittings 23, 24 and 25 of the vapor recovery riser below grade and above each tank, and approximately at right angles to each vapor recovery riser are horizontally positioned vent lines 29, 30 and 31. Vent lines 29–31 include three-inch (inner diameter) flexible hoses 32, 33 and 34 (identified by the trade as FLEX HOSE SOIL SAFE 30). Preferably vent lines and flex hoses are of cylindrical construction. Vent line 29 also includes cross connector 36 as shown in FIG. 1 or two T-connectors 35 and 36 as shown in FIG. 2 and vent lines 30 and 31 include T-connectors 37 and 38 respectively. Each vent includes an additional short run of horizontally positioned pipe 40, 41 and 42 as shown. Thereafter vent lines 29–31 include a longer section of pipe sloping upward toward grade.

As shown in FIGS. 1 and 2, a primary three-manifold bar 44 is connected in fluid communication to and above the vent lines 29–31, through T 35 (or cross T 36) and T's 37 and 38 between flex hoses 32–34 and short pipe sections 40–42. These connections of the manifold 44 to the vent lines are made before the vent lines sloping assent to grade. As shown connections are made by three vertically positioned connection pipes 46, 48 and 50. The manifold bar 44 including the three vertically positioned connection pipes 46, 48 and 50 has an inner diameter larger than the inner diameter of vent lines 29, 30 and 31. Preferably the inner diameter of the manifold bar 44 and connection pipes 46, 48 and 50 is about three inches. The remaining connection of cross-T 36 (FIG. 1) or T-36 (FIG. 2) is fastened to a secondary vapor recovery line 52, in fluid communication with vapor recovery dispensing nozzles (not shown), of gasoline dispensers 54. T-connectors 37 and 38 and cross-T connector 36 have three inch reducing fittings for making the transition to the two inch vent lines 29, 30 and 31 from the three inch manifold bar 44.

Vent lines 29, 30 and 31 are also connected in fluid communication with one another at an underground location remote or downstream from the primary manifold 44 by secondary manifold 56. Secondary manifold 56, like primary manifold 44 is positioned or located above the vent lines as shown in FIG. 2 and preferably has sections with an inner diameter equal in dimension to the inner diameter of the vent lines. As shown in FIG. 1, secondary manifold 56 has three connectors so that the manifold 56 can be fastened to vent lines 29 through 31 and three additional connectors for receiving flex hoses 58, 60 and 62. Flex hoses 58–62 are in fluid communication with secondary manifold 56 and vent lines 29–31. Attached to the second ends of the flex hoses are additional vent lines (not shown) which extend vertically to above ground so that the tanks can be properly vented to the atmosphere if necessary.

Of course, the vapor recovery system 10 shown and described above is used in association with a gasoline dispensing system having all necessary pumps and pipes for pumping gasoline to automobiles. For simplicity, only the product lines 71–73 and the motors 75–77 for pumping hydrocarbon fuel to units for filling the tanks of automobiles have been shown. Also shown, are gauge risers 79–81.

In operation, a tanker truck having at least one delivery hose and at least one vapor recovery hose pulls into a service station. If the tanker truck is delivering regular gasoline, the vapor recovery hose of the truck is connected to vapor recovery hook-up 20 of vapor recovery conduit 17 associated with underground hydrocarbon storage tank 11. Vapor recover risers 18 and 19 remain capped. The fill hose of the truck is inserted into fill riser 14 of tank 11. Noting that time is of the essence gasoline is dumped into storage tank 11 at a rate of about 750 gallons per minute. This rate of liquid flow generates vapors and displaces the generated vapors and other vapors within the tank. Vapors are vented through vapor recovery riser 17 into the tank truck. As a tank fills it may settle further into the ground. Flex hoses 32–34 accommodate such movement without rupture of lines and without straining the connections and fittings of system 10.

When an underground storage tank nears approximately 95% capacity the operator or delivery person shuts off the flow of gasoline to storage tank 11. In the event that the storage tank is left unattended during filling the ball float valve positioned within the vapor recovery riser 17 will be forced up to a seat by the liquid, thus closing off riser 17 and preventing gasoline from entering the fluid communicating system. In the event that the ball valve fails gasoline and vapors will spill into the fluid communicating system. That is, if a tanker continues to deliver gasoline to system 10 the liquid will flow up through vapor recovery riser 17 and drain into vent line 29. A liquid detector/alarm system 66 will alert the operator to an overflow condition. In view of the design and capacity of the described fluid communicating system in combination with alarm 66, the escape of vapors during such overflow will be prevented.

The three hydrocarbon storage tanks may also be filled simultaneously and vapors from individual tanks can be separately collected from each riser. However, because time is of the essence to the tank truck driver it is necessary that the vapor recovery system allow for the simultaneous fill of all storage tanks with a minimum of effort to recover vapor. The system of the invention allows for such efficiency along with the maximum recovery of vapors.

A tank truck delivering three grades of gasoline will have hoses corresponding to the number of grades of gasoline to be delivered. The hoses are fitted to the fill risers 14–16 of storage tanks 11, 12 and 13 after the fill lines are uncapped.

In order to economize time a single vapor recovery line from the truck is connected to one of the vapor recovery risers, preferably line 17. Because three tanks are filled simultaneously a large volume of hydrocarbon vapor is displaced by the liquid and the hydrocarbon liquid entering an empty or near empty tank will generate vapors which are displaced. The initial vapor displaced from tanks 12 and 13 will enter vapor recovery risers 18 and 19 and remain there until the filling operation is over but the remainder of the displaced vapor from tanks 12 and 13 will enter primary manifold 44 through manifold connectors 48 and 50 via risers 18 and 19. The vapor will selectively enter the primary manifold 44 and not vent lines 29–31 because the manifold 44 has a lower pressure drop due to a combination of a larger inner diameter and shorter length than any of the vent lines and primarily because the manifold bar is elevated with respect to the vent lines 29–31. The displaced vapors travel through the primary manifold down manifold connector 46, through flex hose 32 and up vapor recovery riser 17 by virtue of the pressure drop generated by the flow of vapor exiting tank 11 through vapor recovery conduit 17. Vapor not immediately recovered from vapor recovery line 17, that finds its way into vents 29, 30 or 31, will be passed back through the vents via secondary manifold bar 56 and eventually through recovery line 17 or will drop back into the tanks as condensed liquid after the truck makes its drop and all fill conduits and vapor recovery lines are closed.

When the system is closed i.e., during a non-fill situation the tanks will "breath" and vent vapor to the vent lines. Secondary manifold bar 56 will direct much of the vapor back through the vent lines rather than allow such vapor to escape to the atmosphere.

The secondary vapor recovery structure including vapor recovery line 52 recovers the vapors displaced from the tank of an automobile during fill-up. These vapors are recovered in a conventional manner, as disclosed for instance in U.S. Pat. No. 4,047,548 (the disclosure of which is herein incorporated by reference).

Most of the recovered vapors from secondary vapor recovery will be returned to tank 11, via line 52 and flex hose 32 either in the form of vapor or as a liquid. Return of the vapor/liquid is facilitated by gravity. The fact that line 52 is directed back to the lowest grade storage tank prevents the low octane vapors from returning to higher octane storage tanks 12 and 13. Of course the octane value of the tank 11 will increase but contamination is minimal and not undesirable from the consumers point of reference.

It should be apparent that many modifications may be made to the invention without departing from the spirit and scope of the invention. For instance, the system 10 can function with a single manifold located either in the vicinity of the vapor recovery risers or remote from the vapor recovery risers. More efficient vapor recovery is achieved with two manifolds as discussed above. Therefore the drawings and description relating to the use of the invention are presented for purposes of illustration and direction only.

What is claimed is:

1. A vapor recovery system for a service station for recovering volatile hydrocarbon vapors comprising:

a) a plurality of underground hydrocarbon storage tanks, each tank having:

i) first means for filling the hydrocarbon storage tank with a volatile hydrocarbon fluid, ii) second means for recovering hydrocarbon vapor displaced and generated during the filling of the hydrocarbon storage tank, and iii) third means for venting hydrocarbon vapor to the atmosphere which means is connected directly, by a fitting, to and in fluid communication with the second means; and b) an underground primary manifold connected to and in fluid communication with each said third means.

2. The vapor recovery system of claim 1 further comprising a secondary manifold connected to and in fluid communication to each third means, at a position remote from the primary manifold.

3. The vapor recovery system of claim 2 wherein each of the hydrocarbon storage tanks are filled with gasoline of different grades and further comprising fourth means connected in fluid communication to the third means of the hydrocarbon storage tank containing the lowest grade of gasoline at a point substantially within the vicinity of the primary manifold connection, said fourth means is a secondary vapor recovery system for recovering vapors from gasoline dispensing islands.

4. The vapor recovery system of claim 2 further comprising means for detecting liquid located within at least one of said third means.

5. The vapor recovery system of claim 1 wherein each of the hydrocarbon storage tanks are filled with gasoline of different grades and further comprising a fourth means connected in fluid communication to the third means of the hydrocarbon storage tank containing the lowest grade of gasoline at a point substantially within the vicinity of the primary manifold connection, said fourth means is a secondary vapor recovery system for recovering vapors from gasoline dispensing islands.

6. The vapor recovery system of claim 1 wherein each of the second means for recovering hydrocarbon vapors during the filling of each tank extends down into each tank and contains a ball float to prevent overflow of each tank.

7. The vapor recovery system of claim 6 wherein each third means is connected to each second means by a flexible connection.

8. The vapor recovery system of claim 1 further comprising means for detecting liquid located within at least one of said third means.

9. The vapor recovery system of claim 1 wherein an inner diameter of the primary manifold bar is greater than an inner diameter of each said third means.

10. A vapor recovery system for a service station for recovering volatile hydrocarbon vapors during the filling of hydrocarbon storage tanks and the dispensing of hydrocarbons to automobiles, comprising:

a) a plurality of hydrocarbon storage tanks for receiving different grades of gasoline, each tank having i) first means for filling the hydrocarbon storage tank with a volatile hydrocarbon fluid, ii) second means for recovering hydrocarbon vapors displaced and generated during the filling of the hydrocarbon storage tank, iii) third means for venting hydrocarbon vapor to the atmosphere connected to and in fluid communication with the second means;

b) a primary manifold connected to and in fluid communication with each third means in the vicinity of the second means;

c) fourth means for recovering vapor from at least one gasoline dispensing unit of a service station having a first end connected in fluid communication to the third means of a hydrocarbon storage tank containing the lowest grade of gasoline, and having a second end connected to the vapor recovery nozzles of the gasoline dispensing unit of the service station; and d) a secondary manifold located downstream from the primary manifold and connected in fluid communication to each third conduit.

11. The vapor recovery system of claim 10 wherein each third means has a flexible section for connection to each second means.

12. The vapor recovery system of claim 11 wherein the secondary manifold is connected between an underground section of each third means and an aboveground section of each third means.

13. The vapor recovery system of claim 12 wherein each second means extends down into each tank and contains a ball float to prevent overfilling each tank.

14. The vapor recovery system of claim 13 further comprising means for detecting liquid located within at least one of said third means.

15. The vapor recovery system of claim 10 wherein the primary manifold has an inner diameter greater than an inner diameter of the third means.

* * * * *